US005544782A

United States Patent [19]

Lindholm

[11] Patent Number: 5,544,782

[45] Date of Patent: Aug. 13, 1996

[54] PRECISION INVESTMENT CASTING PRESSURE VESSEL

[76] Inventor: Nels O. Lindholm, P.O. Box 5155, Squamish, B.C., Canada, V0N 3G0

[21] Appl. No.: 73,394

[22] Filed: Jun. 7, 1993

[51] Int. Cl.[6] ..... B65D 25/00

[52] U.S. Cl. ..... 220/584; 220/725; 220/728

[58] Field of Search ..... 220/725, 728, 220/584, 726, 729, 727; 137/382, 527.6

[56] References Cited

U.S. PATENT DOCUMENTS

| | | | |
|---|---|---|---|
| 2,278,232 | 3/1942 | Anderson | 220/725 |
| 4,162,740 | 7/1979 | Jones | 220/728 |
| 4,428,395 | 1/1984 | Bravo | 220/725 |
| 4,718,569 | 1/1988 | Swanson | 220/725 |

*Primary Examiner*—Joseph Man-Fu Moy

[57] ABSTRACT

A pressure vessel for reducing air entrapment bubbles inherent in lost pattern type casting mould compounds and for increasing the density of the mould material, which in turn has proven to provide a smoother finished surface to the cast material. The pressure vessel consists of separable upper and lower halves held together under loading with an eccentric cam system. The eccentric cam has an overcenter position which causes a greater closing force to be applied to the pressure vessel as pressure is increased within the chamber. Integral to the closing cam is a separate locking cam which operates in unison with the eccentric cam to prevent the eccentric cam's positioning lever arm from being moved while the chamber of the pressure vessel is pressurized.

14 Claims, 2 Drawing Sheets

PRECISION INVESTMENT CASTING PRESSURE VESSEL

Figure 1:
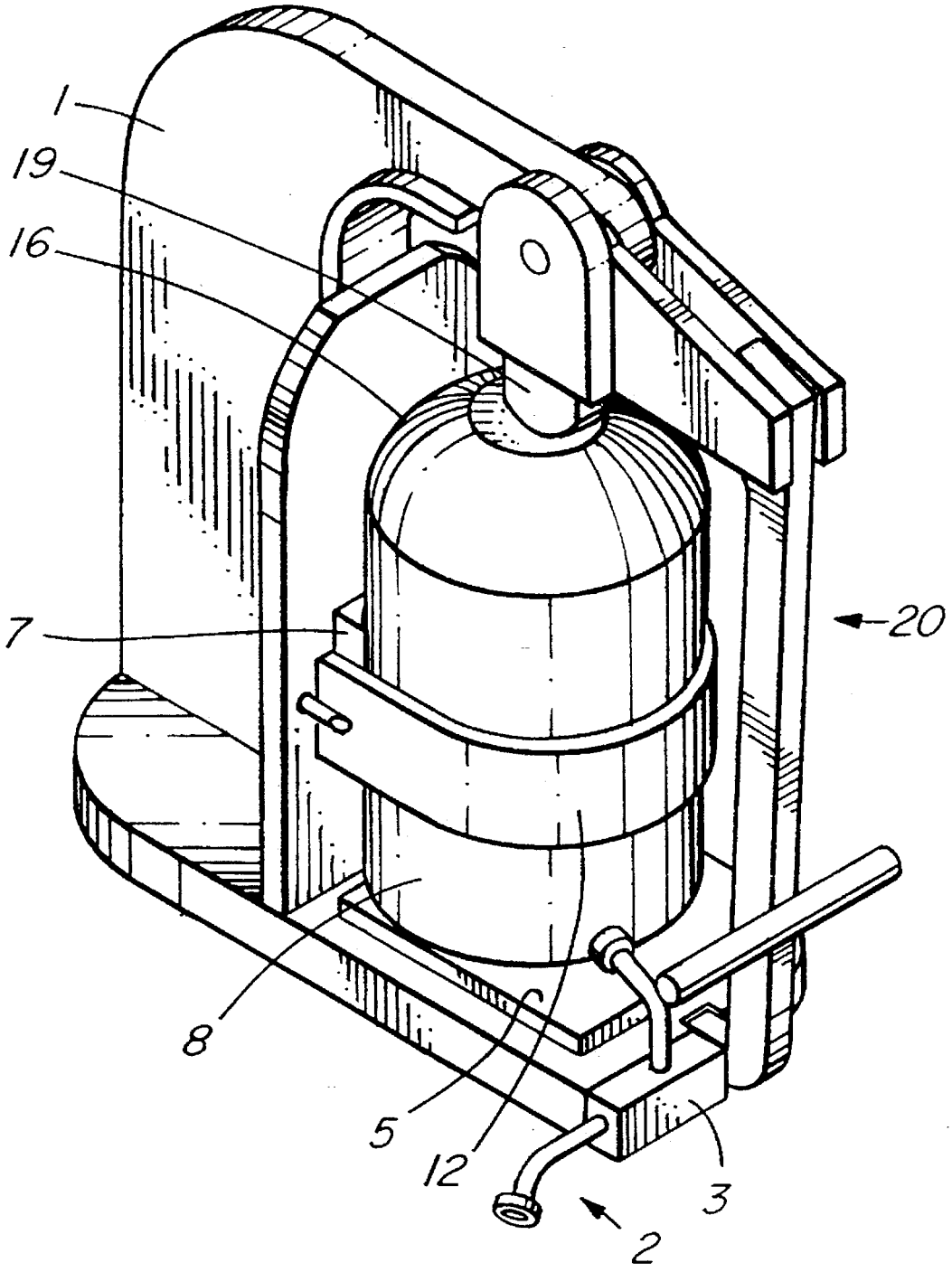
Figure 2:
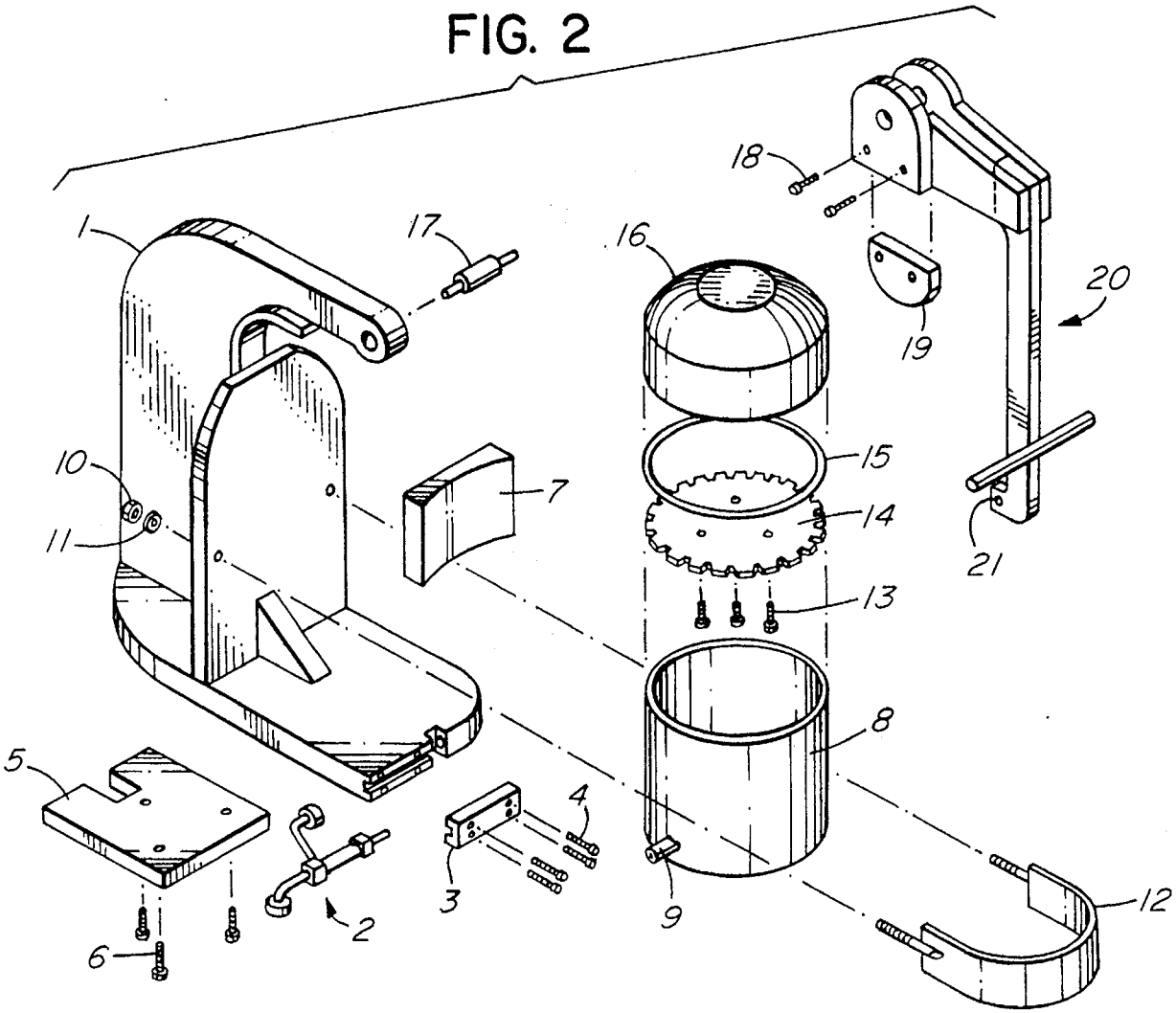

A device to aid in the making of precious and exact dimensioned castings such as but not limited to fine jewellery, dental prosthesis, precision mechanical and non mechanical parts, and art forms, The inventor determined that there was a requirement for a safe labour saving method of making precious castings. The major contributing factor to the labour cost was the relatively rough texture of the surface of the cast product which had to be smoothed or polished to a finer surface finish, The existing methodology of providing a casting vehicle (mould) for investment type castings is to mix an investment material in a vacuum chamber to eliminate air entrapment, then pour this material into a suitable container in which the wax (or other useable material) shape has been fixed with a sprue lead attached while setting the container on a vibrating platform to enhance the liquidity of the investment medium being poured into the said container and to help eliminate air entrapment between the investment material and the face of the shape being cast, The present invention utilizes the lost pattern method of casting, and with the aid of a high pressure environment within tile invention's designed pressure vessel, the inventor claims a smoother, non porous finished surface, as well as a more dense receptive material into which the casting medium is injected, causing less casting defects.

The invention is comprised of a pressure vessel placed within a frame, having a removable upper chamber part which forms a pressure seal against the lower chamber part by means of a conical rim, said rim assisting in the placement of the upper chamber part, and a pressure tight seal allowing the chamber to be pressurized, The compression of the seal is adjustable to compensate for wear by raising the lower part of the chamber from said frame by means of adjustment devices, The upper chamber part is locked in the closed position by a lever attached to said frame, operating a double eccentric cam activated by said lever, said cam applies no pressure onto the upper chamber part until the lever is moved to the closed position, positioning said cam in an over centred position, thereby preventing the upper chamber part from being removed once pressurized, The lever is locked in position by a security device activated by a second cam attached to the pressurization on-off valve, preventing the said lever from being moved while the chamber is pressurized. Depressurization is activated by operating said on-off valve, thereby releasing the security device, allowing the lever to be lifted and the upper chamber part removed allowing access to the contents initially placed in the vessel chamber.

PRECISION INVESTMENT CASTING PRESSURE VESSEL

The present invention relates to a pressure vessel which can be safely operated by a novice or professional and is used for improving the surface texture of fine, precision and detailed castings. Such castings are regularly used for but not limited to precision casting of jewellery, dental prosthesis, (for example but not limited to; crowns, bridges, implant abutments), precision mechanical and non mechanical equipment parts, and art forms.

Various types of pressure vessels are known, ranging from the common pressure cooker for domestic canning to very elaborate units designed for single use applications. These known types of pressure vessels are either incapable of operating at the required precise pressures or are designed for other purposes which make them unsuitable and/or uneconomic for the proposed use of the present invention.

It is desirable to have a precision investment casting pressure vessel which is inherently safe and very simple to operate and which can be economically manufactured and operated. The present invention meets these criteria.

The present invention consists of a number of structural and mechanical parts which when combined in the particular manner herein described operate as a single unit.

In one aspect of the invention, the vessel comprises two hollow suitable shapes made of sufficiently strong material so as to withstand the designed for pressures which are fitted together over a seal surface which in turn is designed so as to eliminate escape of particulate matter from within the container formed by their combination. The combination of the halves over the sealing surface also eliminates the ingress of particulate matter once the seal has been obtained except for that particulate matter (for example but not restricted to; air) which may be injected therein via restricted and designed openings provided in the halves for that purpose.

The openings through which particulate matter may be injected or removed have attached to them a controllable gate type valve through which the particulate matter must flow. Provision is made in the gate valve to prevent the flow of particulate matter in any direction other than that which is desired, and includes the complete stoppage of flow into or out of the container.

To operate the valve for the purpose of injecting particulate matter into the containment area of the combined halves causes an attached or integral part of the valve device to operate a locking mechanism which in turn secures a lever arm used to compress the two halves together over the sealing surface thereby preventing the release of the lever arm during the pressurized state of the containment chamber. The locking device is designed so as to remain in the locked position so long as the pressure inside the chamber exceeds the pressure surrounding the exterior of the chamber.

The lever arm which is locked in position by the operation of the aforementioned valve in turn is attached to a frame structure by a shaft which permits the operation of the lever arm in plane which is vertical to a point on the surface of containment chamber. The lever arm has an eccentric cam shape at one end which bears down in an over-centred position on the surface of the containment chamber when the opposite end of the lever is brought into position at the valve locking mechanism. Once the lever arm is in the locked position, the upper and lower halves of the containment chamber are compressed between the eccentric cam surface of the lever arm on one of the halves, and a portion of the frame structure upon which the other half of the containment chamber is resting.

FIG. "A" is an isometric perspective of an embodiment of a precision investment casting pressure vessel of the invention.

FIG. "B" is an exploded isometric perspective of an embodiment of a precision investment casting pressure vessel of the invention with the parts numbered for descriptive purpose.

The present invention consists of a main frame structure 1 to which is attached a lever arm locking valve mechanism 2 held in place by a lever arm locking mechanism housing 3 affixed by fasteners 4. A plate 5 which has adjustable legs 6 to increase or decrease the plate elevation above the base of the frame structure is placed on the frame structure 1. A backing plate 7 is placed between the frame structure 1 and the pressure vessel 8. Part 8 rests against part 7 and sits on part 5 and is held in place by a strap 12 attached to the frame with a washer 11 and nut 10. The pressure vessel half 8 has an outlet/inlet hole 9 which accepts a fitting which is part of item 2. Into part 8 is placed a bottom spacer plate 14 which has three adjustable legs 13. At the location where the part 8 attaches to the the second half of the pressure vessel 16 there is placed an "0" ring 15 which aids in forming a seal between the two halves of the pressure vessel. The two halves of the pressure vessel, parts 8 and 16 are pressed together by the locking lever arm eccentric cam assembly 19 and 20. The cam is held in place on the lever arm by fasteners 18. The assembly 20 is held in place by a bushed shaft assembly 17 fitted through holes provided in the main frame I and the lever arm 20 at its pivot point, The two halves of the pressure vessel are compressed together by the eccentric cam 19 attached to the lever arm 20 with fasteners 18, when the lever arm is placed in the closed position, causing the cam to be overcentred against the surface of part 16 and allowing the locking shaft of part 2 to pass through a hole 21 in 20 upon initializing pressurization thereby holding the lever arm assembly from being moved during pressurization.

The word pressurization may be read as depressurization in the event that the vessel may be used as a vacuum chamber.

The embodiment of the invention in which an exclusive properity or privilege is claimed are defined as follows:

1. An apparatus for subjecting a work piece to pressure, the apparatus comprising:

(a) a hollow pressure vessel comprising first and second vessel portions having respective sealable complementary edges which cooperate to produce a closed sealed interior of the vessel, and can be separated to permit access to the interior of the vessel to insert and remove the workpiece, the interior being subjectable to an interior pressure different from atmospheric pressure.

(b) a support for supporting the first vessel portion, (c) a clamping or lever arm having a first arm portion hinged to the support for swinging thereabouts and a second arm portion which cooperates with the second vessel portion of the pressure vessel, so that in a first position of the arm the first and second vessel portions are clamped together to close the vessel, and (d) a locking structure to lock the clamping arm with respect to the support, the locking structure including an over-centering latching structure which is over-centered when the clamping arm is in the first position thereof, the locking structure also being responsive to the interior pressure to lock the clamping arm in the first position thereof when the interior of the vessel is subjected to the interior pressure, so as to lock the vessel portions together to prevent opening of the vessel when the interior of the vessel is subjected to the interior pressure.

2. An apparatus as claimed in claim 1, in which the over-centering latching structure comprises:

(a) the first arm portion being hinged to the support for rotation about an arm hinge axis, (b) the clamping arm having a third arm portion, the third arm portion cooperating with the support and the locking structure, and (c) the second arm portion having a contact portion which contacts the second vessel portion and is positioned relative to the arm hinge axis so that when the clamping arm is in the first position thereof, a reactive force from the second vessel portion has a line of reaction passing from the contact portion on a side of the arm hinge axis remote from the second arm portion.

3. An apparatus as claimed in claim 2, in which:

(a) the contact portion has a convex surface which contacts the second portion of the vessel in a camming action while over-centering.

4. An apparatus as claimed in claim 1, in which:

(a) the clamping arm has a third arm portion at a position on the clamping arm remote from the first arm portion, the third arm portion cooperating with the support, and (b) the locking structure cooperates with the support and the third arm portion to lock the clamping arm with respect to the support.

5. An apparatus as claimed in claim 4, in which:

(a) the third arm portion has an opening therein, (b) the support has an opening therein, the openings of the third arm portion and the support being alignable with each other when the arm is in the first position, and (c) the locking structure also includes a plunger adapted to pass through the aligned openings in the support and the third arm portion when the arm portion is in the first position thereof.

6. An apparatus as claimed in claim 5, in which:

(a) the plunger is responsive to the interior pressure applied to the pressure vessel.

7. An apparatus as claimed in claim 6, in which:

(a) when the pressure vessel is at atmospheric pressure, the plunger is in a retracted position clear of at least one of the openings, and the locking structure is disengaged to permit opening of the vessel, and (b) when the pressure is applied to the vessel, the plunger is exposed to at least a portion of the internal pressure and moves to pass through the openings to engage the locking structure so as to lock the clamping arm to prevent opening of the vessel.

8. An apparatus as claimed in claim 5, in which:

(a) the support has a support opening, and the plunger is mounted in the support opening for axial movement along the opening, so that in an extended position the plunger passes through the aligned openings of the support and third arm portion so that the arm is locked to the support, and in the retracted position thereof the plunger is clear of the opening in the third arm portion to permit the clamping arm to be separated from the support for opening the vessel.

9. An apparatus as claimed in claim 1, in which:

(a) the interior pressure in the vessel is higher than atmospheric pressure.

10. An apparatus as claimed in claim 1, in which:

(a) the locking structure includes a movable member cooperating with the clamping arm, the movable member being movable to engage the arm when subjected to at least a portion of the internal pressure so as to lock the arm in the first position.

11. An apparatus as claimed in claim 10, in which:

(a) the movable member is mounted on the support for movement with respect to the support in response to the interior pressure.

12. An apparatus as claimed in claim 11, in which:

(a) the movable member is a plunger, and (b) the support has a plunger cylinder to receive the plunger as a sliding fit therein to permit axial movement of the plunger with respect to the cylinder.

13. An apparatus as claimed in claim 12, in which:

(a) the plunger has an inner end within the plunger cylinder which is exposed to the interior pressure within the pressure vessel, so that, as the interior pressure within the vessel increases, the plunger moves axially outwardly.

14. An apparatus as claimed in claim 12, in which:

(a) the clamping arm has an opening which is alignable with the plunger cylinder when the arm is in the first position, so as to receive the plunger extending from the cylinder to lock the clamping arm.

* * * * *